US010665112B2

(12) United States Patent
Cwalina et al.

(10) Patent No.: US 10,665,112 B2
(45) Date of Patent: May 26, 2020

(54) METHOD AND SYSTEM FOR TEAMING MANNED AND UNMANNED AERIAL VEHICLES

(71) Applicant: Sikorsky Aircraft Corporation, Stratford, CT (US)

(72) Inventors: Cherry Cwalina, San Diego, CA (US); Gary Howland, Stratford, CT (US); Luca F. Bertuccelli, West Hartford, CT (US); Margaret M. Lampazzi, Oxford, CT (US); Robert Pupalaikis, Palm Beach Gardens, FL (US); Thomas Guido, Stormville, NY (US); James S. Magson, North Haven, CT (US); John G. Schoenfeld, Plantsville, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 249 days.

(21) Appl. No.: 15/534,305

(22) PCT Filed: Dec. 15, 2015

(86) PCT No.: PCT/US2015/065727

§ 371 (c)(1),
(2) Date: Jun. 8, 2017

(87) PCT Pub. No.: WO2016/100286

PCT Pub. Date: Jun. 23, 2016

(65) Prior Publication Data

US 2017/0365176 A1 Dec. 21, 2017

Related U.S. Application Data

(60) Provisional application No. 62/091,966, filed on Dec. 15, 2014.

(51) Int. Cl.
*G08G 5/00* (2006.01)

(52) U.S. Cl.
CPC ..... *G08G 5/0013* (2013.01); *G08G 5/0021* (2013.01); *G08G 5/0043* (2013.01); *G08G 5/0069* (2013.01); *G08G 5/0078* (2013.01)

(58) Field of Classification Search
CPC .. G08G 5/0013; G08G 5/0021; G08G 5/0043; G08G 5/0069; G08G 5/0078
See application file for complete search history.

(56) References Cited

U.S. PATENT DOCUMENTS 5,904,724 A * 5/1999 Margolin ..... G05D 1/0038 244/189
7,451,023 B2 11/2008 Appleby et al.
(Continued)

OTHER PUBLICATIONS

International Search Report and Written Opinion of the International Search Authority issued in related PCT Application No. PCT/US2015/065727 dated Feb. 12, 2016, 8 pages.

*Primary Examiner* — Donald J Wallace
(74) *Attorney, Agent, or Firm* — Cantor Colburn LLP

(57) ABSTRACT

A method of teaming a manned aerial vehicle and an unmanned aerial vehicle includes inputting to a controller in a manned vehicle coordinates for an area of interest, plotting a course to the area of interest in a navigation computer operatively connected to the controller, identifying one or more unmanned aerial vehicles (UAVs) near the area of interest, communicating to a ground controller rendezvous coordinates for one of the one or more UAVs, and negotiating a control hand-off of the one of the one or more UAVs from the ground controller to the controller.

14 Claims, 2 Drawing Sheets

(56) References Cited

U.S. PATENT DOCUMENTS

| | | | | |
|---|---|---|---|---|
| 8,079,545 | B2 | 12/2011 | Renshaw | |
| 8,219,799 | B1 | 7/2012 | Lucchesi et al. | |
| 8,713,215 | B2 | 4/2014 | Wade et al. | |
| 9,121,669 | B1 * | 9/2015 | Hyslop | F41G 7/2206 |
| 2003/0212478 | A1 * | 11/2003 | Rios | G05D 1/0044 701/2 |
| 2007/0023570 | A1 * | 2/2007 | Bernard | B64C 13/20 244/75.1 |
| 2011/0084161 | A1 * | 4/2011 | Wallis | F41G 7/30 244/3.13 |
| 2011/0187563 | A1 | 8/2011 | Sanders-Reed | |
| 2011/0208373 | A1 | 8/2011 | Lees et al. | |
| 2012/0261144 | A1 | 10/2012 | Vian et al. | |
| 2013/0311009 | A1 | 11/2013 | McAndrew et al. | |
| 2013/0345920 | A1 | 12/2013 | Duggan et al. | |
| 2014/0339371 | A1 * | 11/2014 | Yates | B64D 39/00 244/53 R |
| 2016/0161258 | A1 * | 6/2016 | Magson | G01C 21/00 |
| 2017/0254622 | A1 * | 9/2017 | Evans | F41G 7/2206 |
| 2017/0357273 | A1 * | 12/2017 | Michini | G05D 1/0022 |

* cited by examiner

METHOD AND SYSTEM FOR TEAMING MANNED AND UNMANNED AERIAL VEHICLES

CROSS-REFERENCE TO RELATED APPLICATIONS

The present application is a 371 National Stage of International Patent Application No. PCT/US2015/065727, filed Dec. 15, 2015, which claims priority to U.S. Provisional Application No. 62/091,966, filed Dec. 15, 2014, the content of which are incorporated herein by reference in their entirety.

BACKGROUND OF THE INVENTION

Exemplary embodiments pertain to the art of aerial vehicles and, more particularly, to a method and system for teaming manned and unmanned aerial vehicles.

Manned aerial vehicles, such as helicopters, are often times employed in unplanned missions to access an area of interest not readily available to ground vehicles. In some cases, the area of interest may represent a hostile environment such as a battle zone. In other cases, the areas may represent a busy or clustered environment such as a heavily populated urban zone or city. In either case, in in most cases a nearby, safe landing zone must be identified to allow personnel to egress from the aerial vehicle and access the area.

For example, rescue personnel may need to egress from a helicopter to access and aid an individual(s) that may be suffering from a battle wound, a motor vehicle injury, or the like. In many cases, the aerial vehicle may need to circle the area of interest to locate a landing zone that is away from hostile fire or that provides sufficient room to allow for landing. Circling an area of interest to locate a desirable landing area could take time and therefore delay providing assistance to a person in the area of interest.

BRIEF DESCRIPTION OF THE INVENTION

Disclosed is a method of teaming a manned aerial vehicle and an unmanned aerial vehicle (UAV). The method includes inputting, to a controller in a manned vehicle, coordinates for an area of interest (AOI), plotting a course to the area of interest in a navigation computer operatively connected to the controller, identifying one or more unmanned aerial vehicles (UAVs) near the area of interest, communicating to a ground controller rendezvous coordinates for one of the one or more UAVs, and negotiating a control hand-off of the one of the one or more UAVs from the ground controller to the controller.

In addition to one or more of the features described above or below, or as an alternative, further embodiments include guiding the UAV to the area of interest with the controller.

In addition to one or more of the features described above or below, or as an alternative, further embodiments include guiding the UAV about the area of interest with the controller.

In addition to one or more of the features described above or below, or as an alternative, further embodiments include controlling a camera on the UAV with the controller.

In addition to one or more of the features described above or below, or as an alternative, further embodiments include displaying images from the UAV in the manned aerial vehicle.

In addition to one or more of the features described above or below, or as an alternative, further embodiments include guiding the UAV back to the ground controller with the controller.

In addition to one or more of the features described above or below, or as an alternative, further embodiments include negotiating a control hand-off from the controller to the ground controller.

Also disclosed is a system in a manned aerial vehicle for teaming with an unmanned aerial vehicle (UAV). The system includes at least one central processing unit (CPU) including a plurality of cores. The at least one CPU is interconnected functionally to a communication module, a navigation module, one or more display modules, and at least one memory device thereupon stores a set of instructions. The set of instructions, when executed by the at least one CPU, causes the system to input to the navigation module coordinates for an area of interest, plot a course to the area of interest in the controller, identify one or more unmanned aerial vehicles (UAVs) near the area of interest, communicate to a ground controller rendezvous coordinates for one of the one or more UAVs, and negotiate a control hand-off of the one of the one or more UAVs from the ground controller to the controller.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
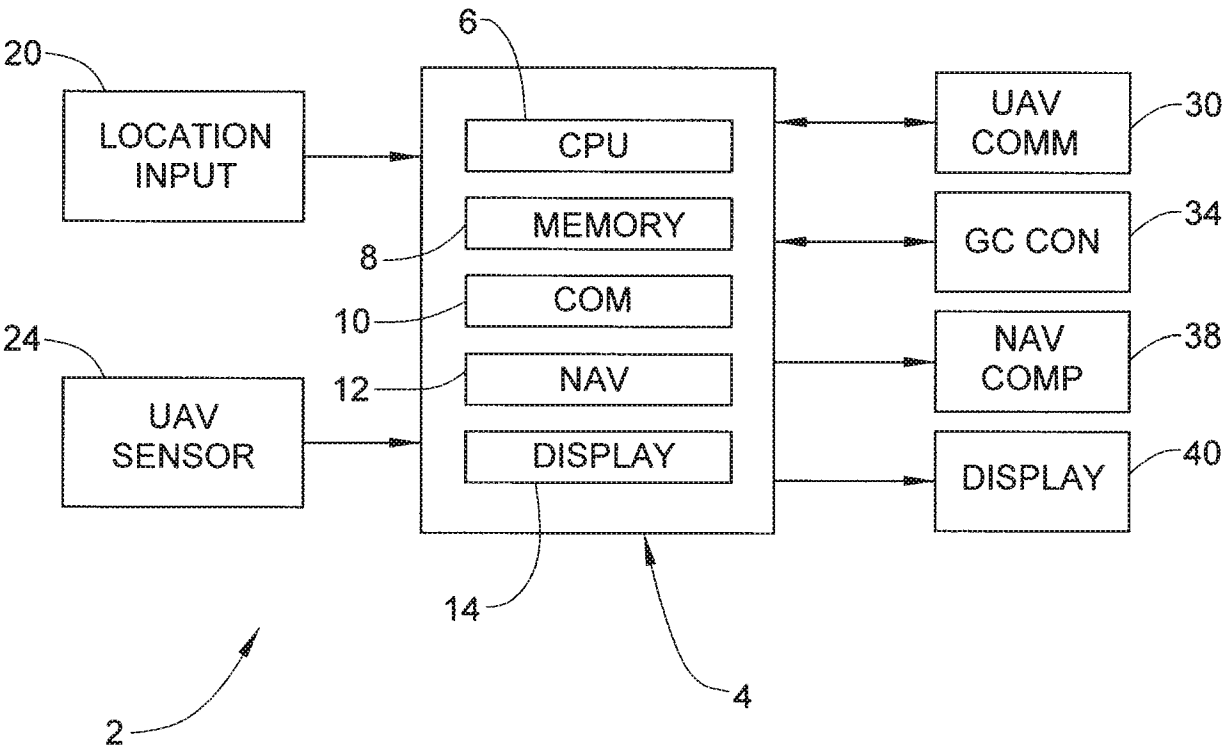
FIG. 1 is a block diagram depicting a system in a manned aerial vehicle for teaming with an unmanned aerial vehicle (UAV)

A manned/unmanned teaming (MUMT) control system, in accordance with an exemplary embodiment, is indicated generally at 2, in FIG. 1. MUMT control system 2 includes a controller 4 having a central processing unit (CPU) 6 and a memory 8. MUMT controller 4 may also include a communication module 10, a navigation module 12, and a display module 14. As will be discussed more fully below, MUMT controller 4 may be operatively connected to a location input system 20 and an unmanned aerial vehicle (UAV) detection system 24. MUMT control system 2 may also be operatively connected to a UAV communications system 30, a ground controller (GC) communications system 34, a navigational computer 38, and one or more displays 40. As will also be discussed more fully below, MUMT controller 4 provides an aircrew with rapid unplanned mission deployment and location intelligence. For example, the MUMT control system 2 may aid a medical evacuation (MEDEVAC) team in locating and retrieving a wounded soldier from a hostile environment.

Figure 2:
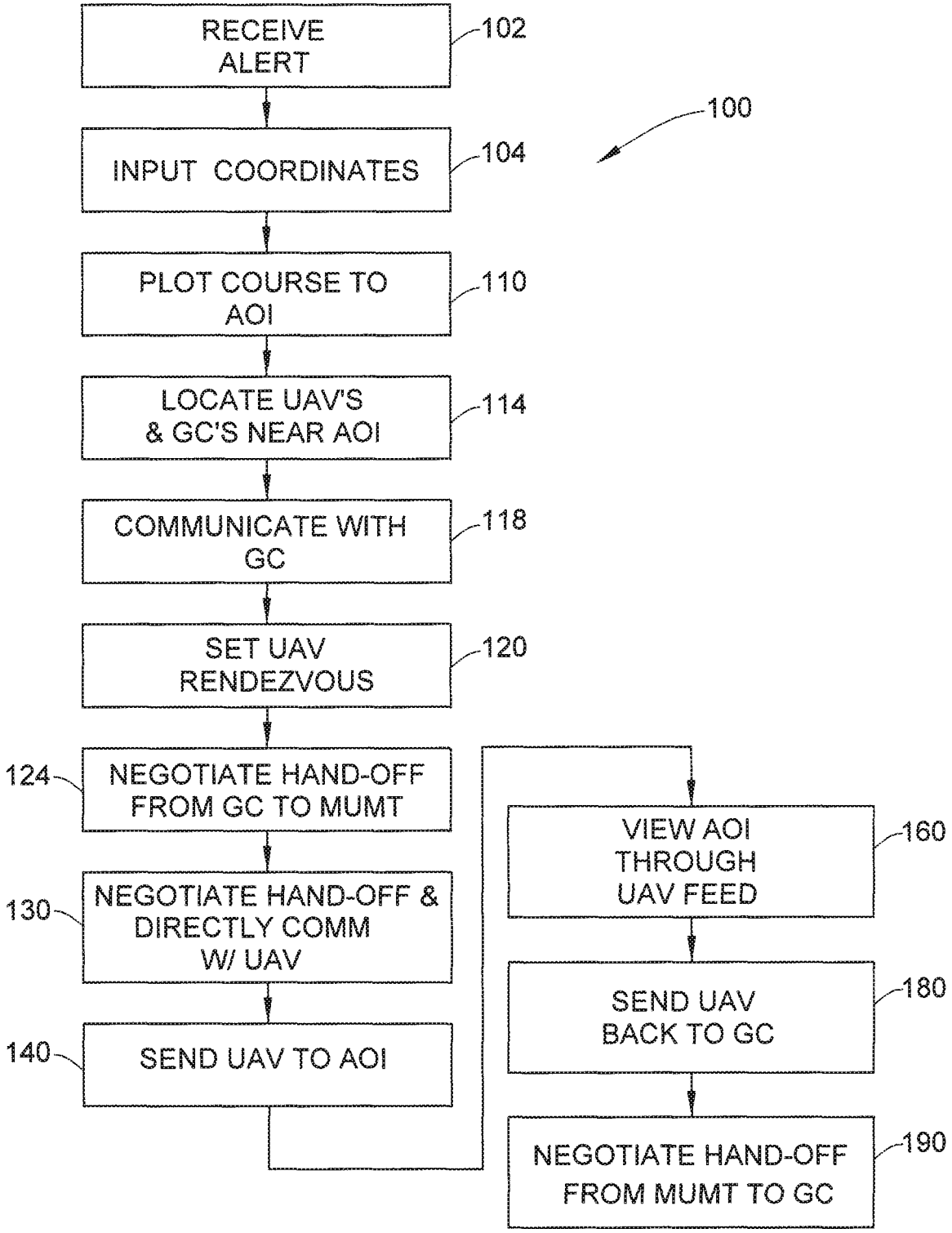
FIG. 2 is a flow diagram illustrating a method of teaming a manned aerial vehicle and a UAV.

FIG. 2 depicts a method 100 of teaming a manned aerial vehicle with a UAV through MUMT control system 2 in accordance with an aspect of an exemplary embodiment. An alert, such as a 9-line or MEDEVAC request may be received such as indicated in block 102. Upon receipt of a 9-line, location information, such as global positioning system (GPS) coordinates of an area of interest (AOI), are input to MUMT control system 2 through location input system 20 in block 104 and passed to navigational computer 38. In block 110, navigational computer 38 plots a course to the AOI. Navigation information and course may be plotted and set before, during and/or after lift-off of the manned aerial vehicle.

MUMT control system 2 locates one or more UAV assets (not shown) and corresponding ground controllers (GCs) (also not shown) near the AOI in block 114. A determination is made which of the UAV assets may be deployed to the AOI and MUMT control system 2 establishes a communication link with the associated GC in block 118. Rendezvous coordinates are calculated and passed to the GC in block 120. The rendezvous coordinates establish a hand-over point in which control of the UAV will pass from the GC to MUMT control system 2. In block 124 a control hand-off from the GC to MUMT control system 2 is negotiated and control of the UAV passes to the manned aerial vehicle in block 130.

In block 140, MUMT control system 2 directs the UAV to the AOI. The UAV passes images, captured by a camera, back to MUMT controller 4 in block 160. The images, still and/or video, are passed to one or more displays 40 through display module 14. At this point, crew members in the manned aerial vehicle may view details of the AOI prior to arrival. Approach headings and/or landing locations may be determined prior to arrival. Further, medical personnel may be above to view the source of the 9-line call and prepare to treat any injured at the AOI. Once landing zones have been identified, consideration can be made to guide the UAV back to a rendezvous with the GC in block 180. A hand-off is negotiated from MUMT control system 2 back to the GC in block 190. The UAV may be set back to the GC prior to landing at the AOI, or the UAV may continue to monitor the AOI until evacuation is complete.

At this point it should be understood that exemplary embodiments describe a manned/unmanned teaming (MUMT) controller that teams a manned aerial vehicle and an unmanned aerial vehicle (UAV) forming a mission synergy. The mission synergy may be advantageously employed during unplanned missions but could also be used during planned missions when a manned/unmanned aerial vehicle teaming could prove desirable. Further, while described as a MEDEVAC mission, it should be understood that the MUMT controller may be employed in a wide array of missions both planned and unplanned.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method of teaming a manned aerial vehicle and an unmanned aerial vehicle, the method comprising:

inputting to a controller in the manned aerial vehicle coordinates for an area of interest;

plotting a course to the area of interest in a navigation computer operatively connected to the controller;

identifying one or more unmanned aerial vehicles (UAVs) near the area of interest;

locating from the manned aerial vehicle one or more ground controllers near the area of interest associated with the one or more UAV's;

communicating from the manned aerial vehicle to the one or more ground controllers rendezvous coordinates for one of the one or more UAVs;

directing the one or more UAV's to the rendezvous coordinates from the one or more ground controllers; and negotiating a control hand-off of the one of the one or more UAVs from the one or more ground controllers to the controller in the manned vehicle.

2. The method of claim 1, further comprising: guiding the one or more UAV's to the area of interest with the controller.

3. The method of claim 1, further comprising: guiding the one or more UAV's about the area of interest with the controller.

4. The method of claim 1, further comprising: controlling a camera on the one or more UAV's with the controller.

5. The method of claim 4, further comprising: displaying images from the one or more UAV's in the manned aerial vehicle.

6. The method of claim 1, further comprising: guiding the one or more UAV's back to the ground controller with the controller.

7. The method of claim 6, further comprising: negotiating a control hand-off from the controller in the manned aerial vehicle back to the ground controller.

8. A system in a manned aerial vehicle for teaming with an unmanned aerial vehicle, the system comprising:

a controller including at least one central processing unit (CPU) including a plurality of cores, the at least one CPU being interconnected functionally to:

a communication module;

a navigation module;

one or more display modules; and at least one memory device thereupon stored a set of instructions which, when executed by the at least one CPU, causes the system to:

input to the navigation module coordinates for an area of interest;

plot a course to the area of interest in the controller;

identify from the manned aerial vehicle one or more unmanned aerial vehicles (UAVs) near the area of interest;

locate from the manned aerial vehicle one or more ground controllers near the area of interest associated with the one or more UAV's;

communicate from the manned aerial vehicle to the one or more ground controllers rendezvous coordinates for one of the one or more UAVs;

direct the one or more UAV's to the rendezvous coordinates from the one or more ground controllers; and negotiate a control hand-off of the one of the one or more UAVs from the one or more ground controllers to the controller in the manned aerial vehicle.

9. The system of claim 8, wherein the set of instructions which, when executed by the at least one CPU, causes the system to guide the one or more UAV's to the area of interest with the controller.

10. The system of claim 8, wherein the set of instructions which, when executed by the at least one CPU, causes the system to guide the one or more UAV's about the area of interest with the controller.

11. The system of claim 8, wherein the set of instructions which, when executed by the at least one CPU, causes the system to control a camera on the one or more UAV's with the controller.

12. The system of claim 11, wherein the set of instructions which, when executed by the at least one CPU, causes the system to display images from the one or more UAV's in the manned aerial vehicle.

13. The system of claim 8, wherein the set of instructions which, when executed by the at least one CPU, causes the system to guide the one or more UAV's back to the ground controller with the controller.

14. The system of claim 13, wherein the set of instructions which, when executed by the at least one CPU, causes the system to negotiate a control hand-off from the controller in the manned aerial vehicle back to the ground controller.

* * * * *